US008701839B2

(12) United States Patent
Friedli

(10) Patent No.: US 8,701,839 B2
(45) **Date of Patent: *Apr. 22, 2014**

(54) ALLOCATION OF CALLS IN A LIFT INSTALLATION

(71) Applicant: Inventio AG, Hergiswil NW (CH)

(72) Inventor: Paul Friedli, Remetschwil (CH)

(73) Assignee: Inventio AG, Hergiswil NW (CH)

( * ) Notice: Subject to any disclaimer, the term of this patent is extended or adjusted under 35 U.S.C. 154(b) by 0 days.

This patent is subject to a terminal disclaimer.

(21) Appl. No.: 13/858,431

(22) Filed: Apr. 8, 2013

(65) Prior Publication Data

US 2013/0220741 A1 Aug. 29, 2013

Related U.S. Application Data

(63) Continuation of application No. 12/863,581, filed on Oct. 12, 2010, now Pat. No. 8,413,766.

(51) Int. Cl.
*B66B 1/20* (2006.01)

(52) U.S. Cl.
USPC ..... 187/384; 187/383

(58) Field of Classification Search
USPC ..... 187/247, 248, 380–388, 391–393, 187/395–399
See application file for complete search history.

(56) References Cited

U.S. PATENT DOCUMENTS

| | | | | |
|---|---|---|---|---|
| 4,718,520 | A * | 1/1988 | Schroder | 187/380 |
| 4,878,562 | A * | 11/1989 | Schroder | 187/387 |
| 4,991,694 | A | 2/1991 | Friedli | |
| 5,317,114 | A | 5/1994 | Pullela et al. | |
| 5,511,634 | A | 4/1996 | Bahjat et al. | |
| 5,616,896 | A | 4/1997 | Kontturi et al. | |
| 5,831,226 | A | 11/1998 | Hattori et al. | |
| 5,948,040 | A | 9/1999 | DeLorme et al. | |
| 6,065,570 | A | 5/2000 | Friedli et al. | |
| 6,991,068 | B2 | 1/2006 | Siikonen et al. | |
| 7,083,027 | B2 | 8/2006 | Siikonen et al. | |
| 7,108,106 | B2 | 9/2006 | Kostka | |
| 7,475,757 | B2 | 1/2009 | Valk et al. | |
| 7,487,861 | B2 | 2/2009 | LaBarre et al. | |
| 7,490,698 | B2 | 2/2009 | Sirag, Jr. | |
| 8,387,757 | B2 | 3/2013 | Christy et al. | |

FOREIGN PATENT DOCUMENTS

| | | | |
|---|---|---|---|
| EP | 0 356 731 | A1 | 3/1990 |
| EP | 0 879 782 | A1 | 11/1999 |
| EP | 1 043 260 | A1 | 10/2000 |
| WO | WO 02/066358 | A1 | 8/2002 |

* cited by examiner

*Primary Examiner* — Anthony Salata
(74) *Attorney, Agent, or Firm* — Stroock & Stroock & Lavan LLP

(57) ABSTRACT

A method of allocating calls of a lift installation with at least one lift and at least one car per lift to move passengers in a journey from at least one input floor to at least one destination floor, a system for executing the method and a computer readable memory with instructions for executing the method. The method includes receiving input calls from passengers travelling from an input floor to a destination floor, each call identifying at least one floor as an input floor or a destination floor. A start zone with identified input floors and a destination zone with identified destination floors are determined from the input calls and destination calls. Each identified floor within a corresponding zone is considered using at least one selection criterion and a stopping floor is selected which satisfies the criterion. The car is caused to stop at fewer than all the identified input floors and identified destination floors during the journey.

20 Claims, 2 Drawing Sheets

ALLOCATION OF CALLS IN A LIFT INSTALLATION

CROSS-REFERENCE TO RELATED APPLICATIONS

This application is a continuation of U.S. Ser. No. 12/863,581, filed Oct. 12, 2010, now U.S. Pat. No. 8,413,766 entitled "METHOD OF ALLOCATING CALLS OF A LIFT INSTALLATION AS WELL AS LIFT INSTALLATION WITH AN ALLOCATION OF CALLS ACCORDING TO THIS METHOD", which is hereby incorporated by reference herein in its entirety.

FIELD OF THE INVENTION

The present invention relates to a method of allocating calls of a lift installation, as well as to a lift installation with an allocation of calls according to this method.

BACKGROUND

A lift installation with a group of lifts and a group control with immediate allocation of calls in the form of destination calls is described in, for example, specification EP 0356731 A1, which is incorporated by reference herein. According to that, a passenger inputs a destination call for a destination floor on an input floor and obtains an immediate allocation of a lift from the group control. The passenger boards the car of the lift and is moved, without the necessity of inputting a further call from inside the car.

The destination floor is communicated to the group control by a destination call already at the input floor and not only by the call in the car. This makes it possible for the group control to carry out allocation of the lifts to reduce the waiting time and/or journey time of the individual passenger. In addition, the transport performance of the lift installation is increased for an unchanged number of lifts.

SUMMARY OF THE INVENTION

An aspect of the present invention is an increase the transport performance of a lift installation.

In an embodiment, the invention relates to a method of allocating calls of a lift installation with at least one lift and at least one car per lift. At least one call to a destination floor is input by at least one passenger. A plurality of passengers is moved, in accordance with input calls, by the car in at least one journey from at least one input floor to at least one destination floor. A start zone with one or more input floors and a destination zone with one or more destination floors are determined for the input calls of the journey If the number of stops in the start zone and/or in the destination zone is greater than one, this number of stops is reduced.

Thus, instead of the waiting time and/or journey time of the individual passenger being optimised in terms of operating costs, the waiting time and/or journey time of the entire car (the occupants of the car) is optimised in terms of operating costs. This takes place by determination of a start zone and/or a destination zone and reduction of the number of stops in the start zone and/or in the destination zone. In departure from the conventional systems where each passenger is necessarily moved from his or her input floor to the destination floor indicated by him or her, a movement of the passengers from a start zone to a destination zone, where there is no stopping at each input floor and/or destination floor, thus takes place. The transport performance of the lift installation is thereby further increased.

The start zone may be formed by the totality of the input floors and he destination zone may be formed by the totality of destination floors.

Accordingly, for each journey of the car it is possible to form virtual zones which can be selectively optimised.

For this purpose, at least one stopping floor in the start zone and/or destination zone may be determined. The input floors and/or the destination floors may be compared with at least one selection criterion and at least one input floor and/or destination floor which best fulfils the selection criterion may be selected as stopping the floor.

Any selection criteria which further increases the conveying performance of the lift installation may be usable. A stopping floor is thus selected in journey-specific manner for predetermined calls.

In an embodiment of the invention, the operating costs of the journey from the start zone to the destination zone may be determined and the operating costs of the journey by way of the selected stopping floor may also be determined.

This allows variations of operating costs to be determined for a selected stopping floor. The operating costs are, for example, the journey costs of the lift installation during movement of the passenger. The minimisation of the number of stops in the start zone and/or in the destination zone is thus quantified, at the lift installation, in variations of operating costs.

For each input floor and/or for each destination floor which is not a selected stopping floor, substitute costs from this input floor to the selected stopping floor of the start zone and/or from this destination floor to the selected stopping floor of the destination zone may be determined. Moreover, total substitute costs can be determined for all input floors and/or for all destination floors which are not a selected stopping floor.

This allows the substitute costs which arise to be determined for a selected stopping floor. Substitute costs include, for example, the travel costs (e.g., travel time or effort) which arise with the passengers in order to go from the input floor and/or destination floor to a selected stopping floor. The minimisation of the number of stops in the start zone and/or in the destination zone is thus quantified, at the passenger side, in substitute costs.

Difference costs can also be determined from the difference of the operating costs of the journey from the start zone to the destination zone (stopping at each selected floor in each zone) and the operating costs of the journey by way of the selected stopping floor in the start zone and the selected stopping floor in the destination zone. Thus, the total substitute costs can be compared with the difference costs. If the total substitute costs are greater than the difference costs additional stopping floors can be selected, but otherwise the car is moved to the selected stopping floor.

As a result, the operating costs and the substitute costs can be determined separately. The difference costs between the operating costs of the journey from the start zone to the destination zone and the operating costs of the journey by way of the selected stopping floor correspond with a gross increase in the transport performance. Subtraction of the total substitute costs from the difference costs supplies a net increase in the transport performance.

In an embodiment, calls may be input by passengers in the form of destination calls to destination floors. Alternatively or in addition, first calls may be input by the passengers at the input floors in the form of direction calls and further calls may be input by the passengers in the car in the form of car calls to destination floors. Accordingly, not only destination calls, but also direction calls can be input at the boarding floors, which makes the field of use very wide.

In one embodiment, the selected stopping floor may be communicated optically and/or acoustically to the passenger by at least one output device. Thus, the passenger is guided by the output device to the selected stopping floor. Moreover, state data of the lift installation and/or travel data to the selected stopping floor can be issued to the passenger on the output device. As a result, the route to the selected transfer floor is clearly and comprehensibly communicated to the passenger. It is indeed the passenger who has to bear the substitute costs in that he or she has to go by foot via a staircase and/or an escalator to the selected transfer floor.

Input floors and/or destination floors which are not a selected stopping floor are not communicated or are conditionally communicated to the passenger.

Thus, the selection of the floors is simplified for the passenger. Those particular floors which with relatively great probability are, for the next journey of the car, not selected as the stopping floor are no longer communicated to the passenger or are communicated only conditionally. A conditional communication is, for example, a marking of the floor as <non-selected stopping floor>. The passenger thus does not have it in mind to select such a non-selected floor, but a stopping floor communicated to him or her is selected. This facilitates and accelerates the call input, call allocation and call acknowledgement.

The method may be iterative, i.e. if the total substitute costs are greater than the difference costs at least one further stopping floor may be determined. For this purpose, each input floor and/or each destination floor which is not a selected stopping floor is compared with at least one selection criterion. At least one input floor and/or at least one destination floor which best fulfils or fulfil the selection criterion may be selected as further stopping floor. The operating costs of the journey by way of the selected stopping floor are determined. For each input floor and/or for each destination floor which is not a selected stopping floor substitute costs from this input floor to the at least one selected stopping floor of the start zone and/or from this destination floor to the at least one selected stopping floor of the destination zone are determined. Total substitute costs are determined for all input floors and/or for all destination floors which are not a selected stopping floor. Difference costs are determined from the difference of the operating costs of the journey from the start zone to the destination zone and the operating costs of the journey via the selected stopping floors. The total substitute costs are compared with the difference costs. If the total substitute costs are greater than the difference costs at least one further stopping floor is determined, but otherwise the car is moved to the selected stopping floors.

If several input floors and/or destination floors fulfil a selection criterion equally well then there is selection of the input floors and/or destination floors as a stopping floor and/or further stopping floor which best fulfils at least one further selection criterion.

A programmed processor uses at least one computer program which is suitable for executing and realising the method for allocation of calls of a lift installation in that at least one method step is performed when it is executed on at least one terminal and/or at least one mobile apparatus and/or at least one lift control. A computer readable data memory may include the program to be executed by the programmed processor. This makes possible a simple and practical distribution of the computer program to the different constituents of the lift installation.

BRIEF DESCRIPTION OF THE DRAWINGS

Embodiments of the invention are explained in detail with reference to the figures, in which.

DETAILED DESCRIPTION OF EXEMPLARY EMBODIMENTS

Figure 1:
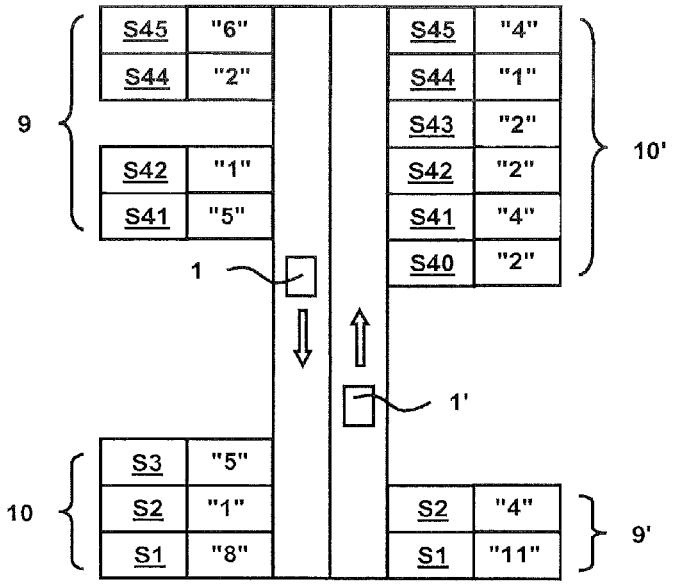
FIG. 1 shows a schematic view of a part of an exemplifying embodiment of a lift installation of the invention.

FIG. 1 shows a lift installation having two lifts each with a respective car 1, 1'. The cars 1, 1' are movable in lift shafts of a building in a vertical direction as indicated by directional arrows. According to FIG. 1 the cars 1, 1' serve forty-five floors S1 to S45. The passengers input calls at input floors and are moved by the cars 1, 1' in the building to individual destination floors. The lifts also include various components, such as lift drives of the cars 1, 1', door drives of the cars 1, 1', lift doors, counterweights, drive and support elements, shaft information means, etc.

A lift control 4 comprises at least one processor, at least one computer readable data memory and at least one electrical power supply. During operation, a computer program is executed, for example, by being loaded from the computer readable data memory into the processor and executed. The control computer program controls the movement of the cars 1, 1' by way of lift drives and the opening and closing of the lift doors by way of door drives. The lift control 4 obtains data about the instantaneous position of the cars 1, 1' in the lift shafts from the shaft sensors. A person of ordinary skill in the art can realise the present invention in any lift installations with substantially more lifts, such as a group with six or eight lifts; with double and triple cars; with several cars, which are arranged one above the other and movable independently of one another, per lift shaft; with lifts without counterweight, with hydraulic lifts; etc.

Figure 2:
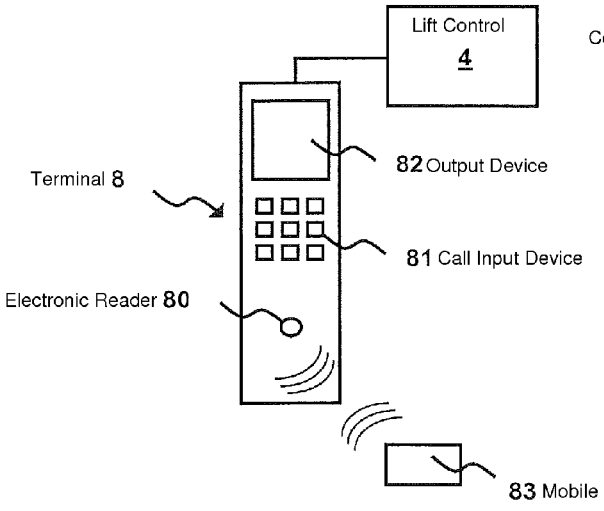
FIG. 2 shows a schematic view of a part of a first exemplifying embodiment of a terminal with a data transmitter of a lift installation according to FIG. 1.
Figure 3:
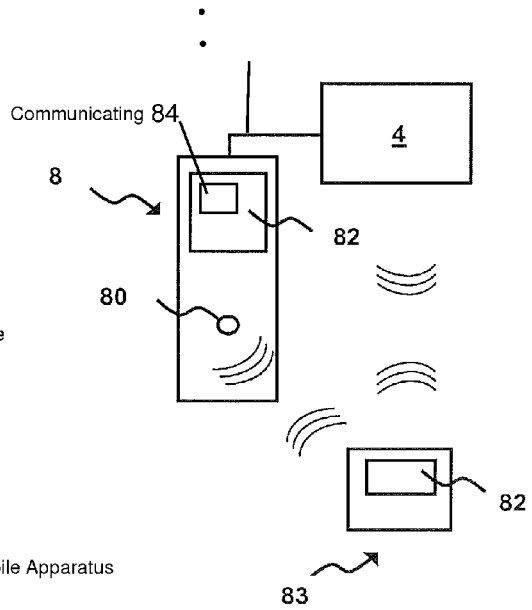
FIG. 3 shows a schematic view of a part of a second exemplifying embodiment of a terminal with a data transmitter of a lift installation according to FIG. 1.

FIGS. 2 and 3 show two exemplifying embodiments of a terminal 8, which is located on the floors S1 to S45 and/or in the cars 1, 1', with mobile apparatus 83 for input of the calls. For example, a terminal 8 is arranged in stationary position near a lift door on each floor. The terminal 8 is, for example, mounted on a building wall or stands in isolation in a space in front of the lift door. An electronic reader 80 and an output device 82 are arranged in the housing of the terminal 8. In addition, a call input device 81 can be arranged in the housing of the terminal 8. The terminal 8 includes a processor, a computer readable data memory and an electrical power supply. An input/output computer program is loaded from the computer readable data memory into the processor and executed. The input/output computer program controls the electronic reader 80, the output device 82 and the call input device 81.

According to FIG. 2 the terminal 8 has, as call input device 81, buttons by which destination floors can be manually input by way of numerical sequences, such as <4> and <4> for the destination floor <44>. Alternatively, the terminal 8 can include, as call input device 81, buttons by which first calls can be manually input in the form of direction calls such as <upwards> or <downwards>. In this embodiment, after the passenger inputs the first calls at the boarding floor the passenger inputs further calls in the form of car calls from within the car at another terminal 8 using a call input device 81 and buttons by way of corresponding numerical sequences to destination floors.

According to FIG. 3 a buttonless terminal 8 can also be used in which the input of the destination floor is carried out contactlessly by reading out a data memory of the mobile apparatus, which is carried by the passenger, by a suitable electronic reader 80 in the terminal 8. The mobile apparatus 83 is, for example, a Radio Frequency Identification Device (RFID) and/or a mobile telephone. As FIG. 2 shows, the contactless call input and the call input by way of buttons can be combined.

The mobile apparatus 83 is carried by the passenger and is, for example, a mobile telephone and/or a computer with at least one transmitting/receiving device. The mobile apparatus 83 includes a processor, a computer readable data memory and an electrical power supply. A computer program is loaded from the computer readable data memory into the processor and executed. The communications computer program controls the transmission and reception of the transmitting/receiving device.

The terminal 8, as well as the mobile apparatus 83, are connected or connectible with the lift control 4 by way of data lines by a fixed network or radio network. In the embodiment of FIG. 3 the lift control 4 and the terminal 8 communicate in a fixed network, whilst the lift control 4 and the mobile apparatus 83 communicate in a radio network. The terminal 8 communicates call data, such as the input floor and the destination floor, of a call to the lift control 4. Upon input of a destination call or a combination of a direction call and a car call, the lift control 4 is thus informed that a passenger is to be moved from the input floor to the destination floor corresponding with the destination call or the car call. The lift control 4 communicates at least one call acknowledgement signal to the terminal 8 and/or the mobile apparatus 83. The communicated call acknowledgement signal can be output on the output device 82. The passenger thus obtains an optical and/or acoustic call acknowledgement on the output device 82, which may be a destination call acknowledgement.

According to FIG. 3 an output device 82 can also be arranged in the mobile apparatus 83. The call control 4 communicates at least one stopping floor signal to the terminal 8 and/or the mobile apparatus 83. At least one input/output computer program can be loaded at the mobile apparatus 83 from the computer readable data memory into the processor and executed. The input/output computer program controls the optical and/or acoustic output of the communicated stopping floor signal at the output device 82. The passenger is thus informed by the lift control 4 about the selected stopping floor. The lift control 4 communicates a state information signal about the lift installation or a travel information signal to the terminal 8 or the mobile apparatus 83. The state information or travel information signal can be optically 84 and/or acoustically issued on the output device 82. The passenger thus also obtains state data about the lift installation and/or travel information, from the lift control 4, which guides him or her quickly and directly to the selected stopping floor. The state information may also include an indication of input or destination floors which are not the selected stopping floor. Such input floors and/or destination floors which will not be a stopping floor for the next journey are not indicated on the output device 82. The passenger then also does not have to input such a non-indicated floor, whereby it also does not thereupon have to be communicated to him or her that the input floor is not a selected stopping floor. It can be communicated 84 to the passenger at some time that he or she has to wait for a later journey of the car if he or she would like to be moved, without substitute costs, to a non-selected floor desired by him or her. With knowledge of the present invention a person of ordinary skill in the art can also realize a lift installation in accordance with the present invention without a terminal, in which the mobile apparatus 82, 83 communicates with a call input device 81 integrated in the lift control 4 or the lift control 4 directly communicates with an output device 82 of the mobile apparatus 83.

Known mobile telephone radio networks such as Global System for Mobile Communication (GSM) at frequencies of 900 to 1900 MHz can be used, but use can also be made of Nearfield Communication (NFC) radio networks. Known radio networks are Wireless Local Area Network (WLAN) according to the standard IEEE 802.11 or Worldwide Interoperability for Microwave Access (WIMAX) according to the standard IEEE 802.16 for the range of several hundreds of meters up to several tens of kilometers. The radio frequency employed by the radio network is, in the case of a WLAN, for example in the 2.4 GHz band or in the 5.0 GHz band and in the case WIMAX in the 10 to 66 GHz band. Not only the fixed network, but also the radio network allow a bidirectional communication according to known and proven network protocols such as the Transmission Control Protocol/Internet Protocol (TCP/IP) or Internet Packet Exchange (IPX). The fixed network comprises, for example, several electrical and/or optical data cables which, for example, are laid in the building to be buried and thus interconnect the terminal 8, the mobile apparatus 83 and the lift control 4.

Figure 4:
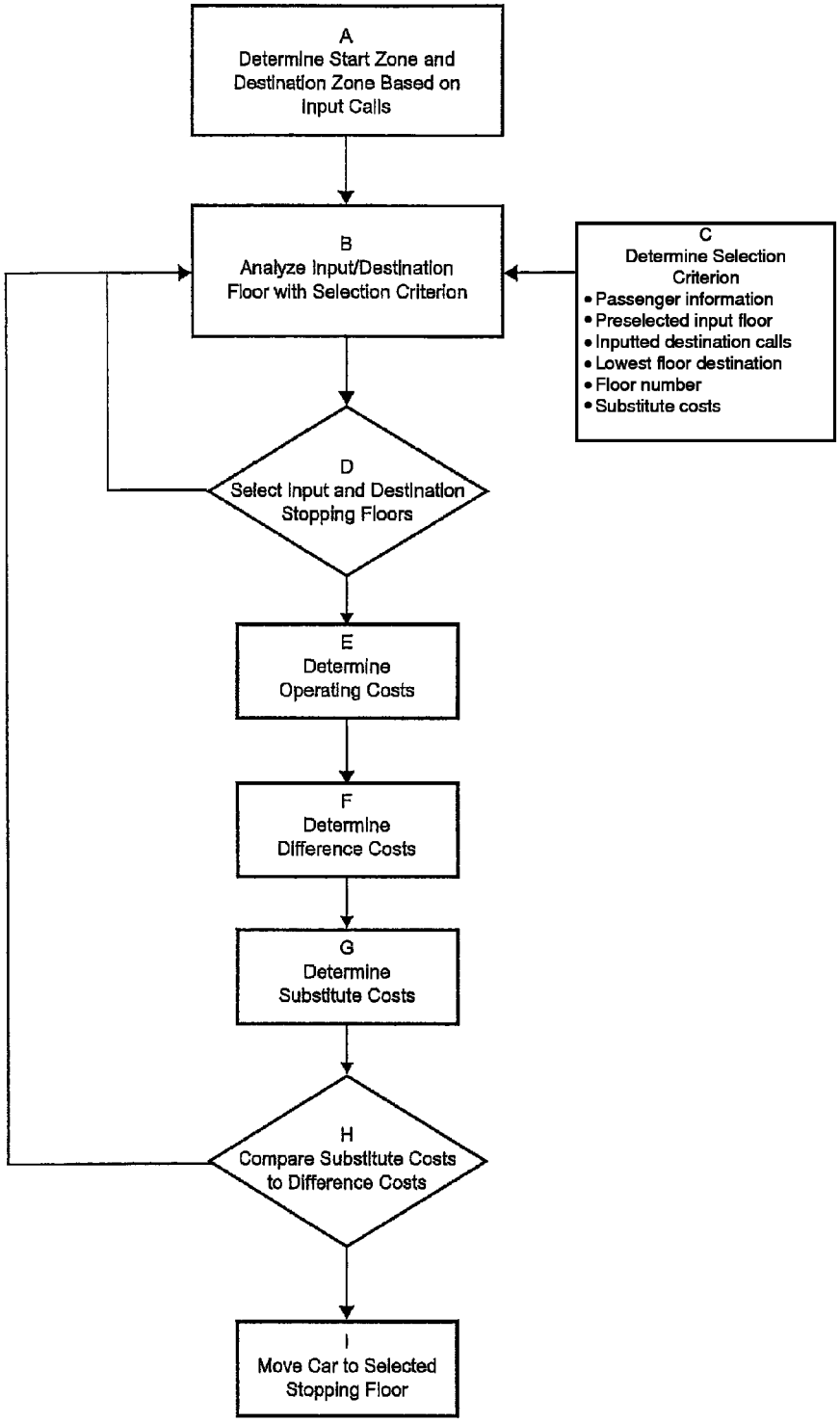
FIG. 4 shows a flow chart of a part of the method according to the invention.

FIG. 4 shows a flow chart of an embodiment of a method for allocation of calls of the lift installation. In the method step A at least one start zone 9, 9' with several input floors and at least one destination zone 10, 10' with several destination floors are determined for the input calls of a journey with the car 1, 1'. According to the example of FIG. 1 the car 1 moves several passengers from the start zone 9, which is formed by the four input floors S41, S42, S44 and S45, to the destination zone 10, which is formed by the three destination storeys S1, S2 and S3 and the car 1' moves several passengers from the start zone 9', which is formed by the two input floors S1 and S2, to the destination zone 10', which is formed by the six destination floors S40, S41, S42, S43, S44 and S45. The totality of the input floors forms the start zone 9, 9'. The totality of the destination floors forms the destination zone 10, 10'.

At least one operating costs computer program is loaded from the computer readable data memory of the lift control 4 into the processor of the lift control 4 and executed. The operating costs computer program determines the operating costs of a journey with the car 1, 1'. From the call data communicated by the terminal, the operating costs computer program composes a journey with the car 1, 1' and lists for this journey the number of destination calls or direction calls per input floor as well as the number of destination calls or car calls per destination floor. According to FIG. 1, for the journey of the car 1 five passengers input calls at the input floor S41, one passenger inputs a call at the input floor S42, two passengers input calls at the input floor S44 and six passengers input calls at the input floor S45. Of these fourteen passengers, eight passengers want the destination floor S1, one passenger wants the destination floor S2 and five passengers want the destination floor S3. Correspondingly, for the journey of the car 1' eleven passengers input calls at the input floor S1 and four passengers input calls at the input floor S2. Of these fifteen passengers two passengers want the destination floor S40, four passengers want the destination floor S41, two passengers want the destination floor S42, two passengers want the destination floor S43, one passenger wants the destination floor S44 and four passengers want the destination floor S45.

The operating costs of the journey from the start zone 9, 9' to the destination zone 10, 10' are minimised by reduction of the number of stops in the start zone 9, 9 and/or in the destination zone 10, 10'. At least one stopping floor in the start zone 9, 9' is determined and/or at least one stopping floor in the destination zone 10, 10' is determined.

For this purpose, each input floor and/or each destination floor is analyzed using at least one selection criterion by the operating costs computer program in the method step B. The selection criteria can be called up from a data memory.

The selection criterion is determined by the operating costs computer program in method step C. Several selection criteria are explained in detail below:

Number of calls—The number of input calls per input floor and/or destination floor may serve as selection criterion. Thus, the input floor and/or destination floor with the highest number of input calls may be selected as a stopping floor. This selection criterion determines the smallest number of floor changes the passengers have to undertake. According to FIG. 1, in the case of the journey of the car 1 in the start zone 9, the input floor S45 with six calls has the most calls and in the destination zone 10 the destination floor S1 with eight calls has the most calls, which makes these floors into stopping floors. If several input floors and/or destination floors have an equally high number of input calls, these input floors and/or destination floors can each be selected as stopping floors. According to FIG. 1, in the case of the journey of the car 1' in the start zone 9' the input floor S1 with eleven calls has the most calls and in the destination zone 10' the two destination floors S41 and S45 each with four calls have the most calls. Thus, each of these destination floors can be made into stopping floors in the destination zone 10'. If several input floors and/or destination floors have an equally high number of input calls, it is also possible to select those of the two input floors and/or two destination floors with the greatest floor difference from one another as the stopping floors. According to FIG. 1, in the case of the journey of the car 1' in the destination zone 10' the three destination floors S40, S42 and S43 each with two calls have the second-highest number of calls, wherein the destination floors S40 and S44 have the greatest floor difference from one another, which makes these destination floors into further stopping floors in the destination zone 10'. As already described, the calls can be not only destination calls or direction calls of an input floor, but also destination calls or car calls of a destination floor.

Lowest total floor difference—The total of the floor difference of the input floors from one another and/or the floor difference of the destination floors from one another may also serve as selection criterion. In that case the input floor with the lowest total floor difference from the other input floors and/or the destination floor with the lowest total floor difference from the other destination floors may be selected as the stopping floor. This approach does not take into account the direction of travel between floors. This selection criterion determines the shortest route which the passengers must cover. According to FIG. 1, in the case of the journey of the car 1 in the start zone 9 the two input floors S42 and S44 lie centrally between the input floors S41 and S45. In order to reach the input floor S44, six passengers from the input floor S45 have to cover one floor difference, one passenger of the input floor S42 has to cover two floor differences and five passengers of the input floor S41 must cover three floor differences, which in total gives twenty-three absolute floor differences. In order to reach the input floor S42 the six passengers of the input floor S45 have to cover three floor differences, two passengers of the input floor S44 have to cover two floor differences and five passengers of the input floor S41 have to cover one floor differences, which in total gives twenty-seven absolute floor differences, whereby the input floor S44 is selected as stopping floor in the start zone 9.

Lowest relative floor difference—The total floor difference of the input floors from one another and/or the destination floors from one another may also serve as selection criterion taking into account the direction of travel between floors. In that case, the input floor with the lowest floor difference from the other input floors and/or the destination floor with the lowest floor difference from the other destination floors is selected as the stopping floor. This selection criterion determines the smallest ascent in the building the passengers have to cover. It is thus taken into consideration that passengers rather prefer to go down stairs in the building (negative floor difference) than up (positive floor difference). According to FIG. 1, in the case of the journey of the car 1 in the start zone 9 the two input floors S42 and S44 lie centrally between the input floors S41 and S45. In order to reach the input floor S44 six passengers of the input floor S45 have to cover a negative floor difference, one passenger of the input floor S42 has to cover two positive floor differences and five passengers of the input floor S41 have to cover three positive floor differences, which gives in total eleven positive floor differences. In order to reach the input floor S42 the six passengers of the input floor S45 have to cover three negative floor differences, two passengers of the input floor S44 have to cover two negative floor differences and five passengers of the input floor S41 have to cover one positive floor difference, which gives in total seventeen negative floor differences, whereby the input floor S42 is selected as stopping floor in the start zone 9.

Lowest or highest floor number—The number of the floors of the start zone 9, 9' and/or in the destination zone 10, 10' may also serve as selection criterion. This selection criterion is based on the assumption that most passengers are located in the floor with the lowest floor number and/or in the floor with the highest floor number. In addition, passengers rather prefer to go down stairs in the building than up. In the case of upward journeys the input floor with the lowest floor number and/or the destination floor with the highest floor number is or are selected as the stopping floor. In the case of downward journeys the input floor with the highest floor number and/or the destination floor with the lowest floor number may be selected as stopping floor. According to FIG. 1, in the case of the journey of the car 1 in the start zone 9 the input floor S45 with the highest floor number also with six calls has the most calls and in the destination zone 10 the destination floor S1 with the lowest floor number with eight calls also has the most calls, which makes these floors be chosen as the stopping floors.

Second-lowest or second-highest floor number—The number of the floors again serves as selection criterion. This time the selection criterion is based on the assumption that the most passengers are located in the floor with the second-lowest floor number and/or in the floor with the second-highest floor number.

Lowest building floor difference—The floor difference between the input floors and the destination floors may also serve as selection criterion. The input floor and the destination floor with the lowest floor difference from one another are selected as stopping floors. This selection criterion is based on the assumption that the lower the building floor difference, the more rapidly the journey of the car 1, 1' takes place. According to FIG. 1, in the case of the journey of the car 1' the input floor S2 has the highest floor number of the start zone 9' and the destination floor S40 has the lowest floor number of the destination zone 10', which makes these floors into stopping floors.

Predefined input floor—According to this selection criterion a predefined input floor and/or destination floor may be selected as stopping floor.

Floor substitute costs—The level of the substitute costs of an input floor and/or destination floor, which is not a selected stopping floor, may also serve as selection criterion. With this criterion, the system is prevented from consistently neglecting, i.e. not choosing, certain input or destination floors as stopping floors. Accordingly, the input floor and/or destination floor with the greatest substitute costs over a certain length of time may be determined and selected as a stopping floor. Alternatively, the input floor and/or destination floor that has reached a threshold value of substitute costs can be determined and selected as a stopping floor. This selection criterion is based on the approach that all floors are, as far as possible, to be allocated the same substitute costs. The time unit is freely selectable and amounts to, for example, a week. The threshold value is similarly freely divisible and amounts to, for example, a fifth of the floor number of the building.

Passenger identification—Passenger identifications of the passengers can also be used as selection criterion. The determined passenger identifications are compared with a values list. Passenger identifications can be input by the passenger at the terminal 8 by actuation of buttons of the call input device 81. However, passenger identifications can also be contactlessly detected by reading out from the computer readable data memory of the mobile apparatus 82, 83. Other technical passenger identification determination possibilities, such as recognition of biometric data of the passenger and/or scanning of identity means of the passenger, are equally usable. A passenger identification having the greatest value according to the values list is determined. The input floor and/or the destination floor, which has the call of the passenger with the passenger identification of greatest value, is selected as the stopping floor. For example, a VIP identification and/or a handicapped-person identification of a passenger may be determined as passenger identification. According to the values list the presence of a VIP identification and/or handicapped-person identification is allocated greater value than is the non-presence of a VIP identification and/or handicapped-person identification. If several input floors and destination floors have a call of a passenger with VIP identification and/or handicapped-person identification, these input floors and/or destination floors can each be selected as stopping floors.

Substitute costs—A sum of the substitute costs, which are collected over a certain time, of a passenger may be determined as passenger identification. According to a values list the greatest sum of the substitute costs, which are collected during a time unit, of a passenger is allocated the greatest value. Thus, the floors selected as stopping floors may be determined to favour a person who has collected a large sum of substitute costs over a certain time. This selection criterion is based on the approach that all passengers shall, as far as possible, bear the same substitute costs. The time unit is freely selectable and amounts to, for example, a week. Passengers who in a week collect relatively high substitute costs to say cover much travel by way of stairs and/or escalators to selected stopping floors, are, in accordance with the values list, compensated for that in a following week.

Random—According to this selection criterion a random input floor and/or destination floor may be selected as the stopping floor.

With knowledge of the present invention it is freely available to a person of ordinary skill in the art to combine several of these selection criteria together to form a selection criterion and/or use several of these selection criteria in any sequence in succession.

At least one input floor and/or at least one destination floor, which best fulfils the particular selection criterion, may be selected as the stopping floor in method step D. The operating costs computer program works down at least one or more selection criteria according to the predetermined calls at the input floors and/or destination floors and selects an optimum stopping floor in a journey-specific manner.

In method step E on the one hand the operating costs of the journey from the start zone to the destination zone and on the other hand the operating costs of the journey by way of the selected stopping floor are determined by the operating costs computer program. The operating costs are the journey costs of the lift installation during movement of the passengers. The minimisation of the stops in the start zone and/or in the destination zone is thus quantified on the side of the lift installation.

In method step F difference costs are determined by the operating costs computer program in that the difference of the operating costs of the journey from the start zone to the destination zone and the operating costs of the journey by way of the selected stopping floor is formed.

In method step G there is determined, by the operating costs computer program, for each input floor and/or for each destination floor which is not a selected stopping floor substitute costs from this input floor to the selected stopping floor of the start zone 9, 9' and/or from this destination floor to the selected stopping floor of the destination zone 10, 10'. Total substitute costs are determined for all input floors and/or for all destination floors which are not a selected stopping floor. Substitute costs are the travel costs which arise for the passengers in order to go from the input floor and/or destination floor to a selected stopping floor. The minimisation of the stops in the start zone 9, 9' and/or in the destination zone 10, 10' is thus quantified at the passenger side.

The total substitute costs are compared with the difference costs by the operating costs computer program in method step H. If the total substitute costs are greater than the difference costs at least one further stopping floor is selected. Otherwise, the car 1, 1' is moved to the selected stopping floor (Step I).

While there have been shown and described particular features of the invention as applied to preferred embodiments thereof, it will be understood that various omissions, substitutions, and changes in the form and details of the devices illustrated, and in their operation, may be made by those skilled in the art without departing from the spirit and scope of the invention.

The invention claimed is:

1. A lift installation operation method, comprising:

determining, for a lift journey and using a computer, a start zone in a building, the start zone comprising input building floors identified in destination calls inputted by two or more passengers;

determining, for the lift journey and using the computer, a destination zone in the building, the destination zone comprising destination building floors identified in the destination calls;

selecting, using the computer, a stopping floor from the start zone of floors or from the destination zone of floors, the selecting of the stopping floor being based on a selection criterion; and transporting the two or more passengers in a car of a lift installation between the start zone and the destination zone during the lift journey, the transporting comprising omitting a stop for at least one of the input building floors or at least one of the destination building floors.

2. The lift installation operation method of claim 1, further comprising communicating to one of the passengers to exit the car at a floor other than a destination building floor identified in a destination call inputted by the passenger.

3. The lift installation operation method of claim 1, further comprising communicating to one of the passengers to enter the car at a floor other than an input building floor identified in a destination call inputted by the passenger.

4. The lift installation operation method of claim 3, the communicating to the one of the passengers being performed using a destination call input terminal.

5. The lift installation operation method of claim 3, the communicating to the one of the passengers being performed before the passenger enters the car.

6. The lift installation operation method of claim 1, the selection criterion comprising passenger identification.

7. The lift installation operation method of claim 1, the selection criterion comprising a predefined input floor.

8. The lift installation operation method of claim 1, the selection criterion comprising a number of inputted destination calls.

9. The lift installation operation method of claim 1, the selection criterion comprising a lowest floor difference.

10. The lift installation operation method of claim 1, the selection criterion comprising a floor number.

11. The lift installation operation method of claim 1, the selection criterion comprising a substitute cost.

12. A lift installation, comprising:

a car; and a lift control, the lift control comprising a processor and a computer readable data memory, the computer readable data memory having encoded thereon instructions that, when executed by the processor, cause the lift control to perform a method, the method comprising, determining, for a lift journey and using a computer, a start zone in a building, the start zone comprising input building floors identified in destination calls inputted by two or more passengers, determining, for the lift journey and using the computer, a destination zone in the building, the destination zone comprising destination building floors identified in the destination calls, selecting, using the computer, a stopping floor from the start zone of floors or from the destination zone of floors, the selecting of the stopping floor being based on a selection criterion, and transporting the two or more passengers in the car between the start zone and the destination zone during the lift journey, the transporting comprising omitting a stop at at least one of the input building floors or at least one of the destination building floors.

13. A computer readable memory programmed with instructions that, when executed by a processor, cause the processor to perform a method, the method comprising:

determining, for a lift journey and using a computer, a start zone in a building, the start zone comprising input building floors identified in destination calls inputted by two or more passengers;

determining, for the lift journey and using the computer, a destination zone in the building, the destination zone comprising destination building floors identified in the destination calls;

selecting, using the computer, a stopping floor from the start zone of floors or from the destination zone of floors, the selecting of the stopping floor being based on a selection criterion; and transporting the two or more passengers in a car of a lift installation between the start zone and the destination zone during the lift journey, the transporting comprising omitting a stop at at least one of the input building floors or at least one of the destination building floors.

14. A lift installation operating method, comprising:

receiving, using a destination call input terminal, a destination call for a passenger, the destination call being associated with an indicated departure floor in a building and with an indicated destination floor in the building;

determining, using a computer, a start zone of floors in the building and a destination zone of floors in the building, the determining being based on the destination call for the passenger and another destination call for another passenger; and based on the start zone of floors and the destination zone of floors, instructing the passenger to board a lift car at a floor other than the indicated departure floor or to exit the lift car at a floor other than the indicated destination floor, the lift car being a single-cabin lift car.

15. The lift installation operating method of claim 14, the instructing the passenger to board the lift car at the floor other than the indicated departure floor comprising: displaying travel data for traveling from the indicated departure floor to the floor other than the indicated departure floor.

16. The lift installation operating method of claim 14, the instructing the passenger to exit the lift car at the floor other than the indicated destination floor comprising: displaying travel data for traveling from the floor other than the indicated destination floor to the indicated destination floor.

17. The lift installation operating method of claim 14, further comprising communicating state data of the lift installation to the passenger.

18. The lift installation operating method of claim 17, the state data of the lift installation comprising an indication of a floor at which the lift car will not stop during a lift trip.

19. The lift installation operating method of claim 17, the state data of the lift installation comprising an indication that a lift trip from the indicated departure floor to the indicated destination floor will be available later.

20. The lift installation operating method of claim 14, further comprising determining a substitute cost for the indicated departure floor or the indicated destination floor.

* * * * *

UNITED STATES PATENT AND TRADEMARK OFFICE

CERTIFICATE OF CORRECTION

PATENT NO. : 8,701,839 B2
APPLICATION NO. : 13/858431
DATED : April 22, 2014
INVENTOR(S) : Paul Friedli It is certified that error appears in the above-identified patent and that said Letters Patent is hereby corrected as shown below:

On the title page, please change item (22) from:

"(22) Filed: Apr. 8, 2013"

To:

--(22) PCT Filed: Jan. 15, 2009

(86) PCT No.: PCT/EP2009/050409
§ 371 (c)(1),
(2), (4) Date: Oct. 12, 2010

(87) PCT Pub. No.: WO2009/090206
PCT Pub. Date: Jul. 23, 2009--

On the title page, please change the following Related U.S. Application Data from:

"(63) Continuation of application No. 12/863,581, filed on Oct. 12, 2010, now Pat. No. 8,413,766."

To:

--(63) Continuation of application No. 12/863,581, filed on Oct. 12, 2010, now Pat. No. 8,413,766.

(60) Provisional application No. 61/021,690, filed on Jan. 17, 2008.

(30) Foreign Application Priority Data
Jan. 17, 2008 (EP).....08100580--

Signed and Sealed this
Seventeenth Day of June, 2014

Michelle K. Lee

Michelle K. Lee
*Deputy Director of the United States Patent and Trademark Office*

In the Specification

In column 1, lines 6-14 of 8,701,839 B2, please change the paragraph under CROSS-REFERENCE TO RELATED APPLICATIONS from:

"This application is a continuation of U.S. Ser. No. 12/863,581, filed Oct. 12, 2010, now U.S. Pat. No. 8,413,766 entitled "METHOD OF ALLOCATING CALLS OF A LIFT INSTALLATION AS WELL AS LIFT INSTALLATION WITH AN ALLOCATION OF CALLS ACCORDING TO THIS METHOD", which is hereby incorporated by reference herein in its entirety."

To:

--This application is a continuation U.S. Serial No. 12/863,581, filed October 12, 2010, now U.S. Patent No. 8,413,766 entitled "METHOD OF ALLOCATING CALLS OF A LIFT INSTALLATION AS WELL AS LIFT INSTALLATION WITH AN ALLOCATION OF CALLS ACCORDING TO THIS METHOD," which is hereby incorporated by reference herein in its entirety, which claims priority to PCT/EP2009/050409 filed January 15, 2009, which claims priority to Provisional Application No. 61/021,690 filed January 17, 2008 and European Application No. 08100580.3 filed January 17, 2008.--